US007882929B2

(12) United States Patent
Hotta et al.

(10) Patent No.: US 7,882,929 B2
(45) Date of Patent: Feb. 8, 2011

(54) DELIVERY PIPE

(75) Inventors: Takashi Hotta, Toyota (JP); Tamiyuki Nakane, Okazaki (JP); Katsutoshi Kato, Okazaki (JP)

(73) Assignees: Toyota Jidosha Kabushiki Kaisha, Toyota-shi (JP); Maruyasu Industries Co., Ltd., Nagoya-shi (JP)

( * ) Notice: Subject to any disclaimer, the term of this patent is extended or adjusted under 35 U.S.C. 154(b) by 4 days.

(21) Appl. No.: 10/594,563

(22) PCT Filed: Mar. 15, 2005

(86) PCT No.: PCT/JP2005/005069

§ 371 (c)(1),
(2), (4) Date: Jun. 1, 2007

(87) PCT Pub. No.: WO2005/100775

PCT Pub. Date: Oct. 27, 2005

(65) Prior Publication Data

US 2008/0017443 A1 Jan. 24, 2008

(30) Foreign Application Priority Data

Apr. 12, 2004 (JP) ..... 2004-116352

(51) Int. Cl.
*F02M 69/46* (2006.01)

(52) U.S. Cl. ..... 181/252; 181/256; 123/456

(58) Field of Classification Search ..... 181/196, 181/252, 256, 258; 123/456
See application file for complete search history.

(56) References Cited

U.S. PATENT DOCUMENTS 2,599,325 A * 6/1952 Fritzberg ..... 138/28
4,600,076 A * 7/1986 Yamamoto et al. ..... 181/233
4,872,528 A * 10/1989 Goplen et al. ..... 181/228
4,897,906 A * 2/1990 Bartholomew ..... 29/890.09
4,924,966 A * 5/1990 Kanda et al. ..... 181/228
5,365,025 A * 11/1994 Kraai et al. ..... 181/249
5,452,577 A * 9/1995 Langer ..... 60/299
5,617,827 A 4/1997 Eshleman et al.
2003/0106535 A1 6/2003 Zdroik et al.
2004/0107943 A1* 6/2004 Alder et al. ..... 123/456
2004/0144367 A1* 7/2004 Braun et al. ..... 123/456

FOREIGN PATENT DOCUMENTS

EP 1 445 475 A1 8/2004
JP 08-246984 A 9/1996
JP 09-053541 A 2/1997
JP 09060786 A * 3/1997
JP 2000-240530 A 9/2000

(Continued)

*Primary Examiner*—Elvin G Enad
*Assistant Examiner*—Jeremy Luks
(74) *Attorney, Agent, or Firm*—Kenyon & Kenyon LLP

(57) ABSTRACT

A delivery pipe includes an outer pipe, an inner pipe, and a noise emission decreasing device. The outer pipe is connected to a plurality of fuel injectors. The inner pipe is disposed in the outer pipe and has an open end through which an interior of the inner pipe communicates with atmosphere. The noise emission decreasing device acts so as to decrease a noise emitted from the inner pipe. The noise emission decreasing device includes a mesh, a porous member, a vibration suppressing member provided to the inner pipe, an elastic tube fitted into the inner pipe, or a wire harness inserted into the inner pipe.

1 Claim, 2 Drawing Sheets

FOREIGN PATENT DOCUMENTS

| | | | |
|---|---|---|---|
| JP | 2001-241368 | A | 9/2001 |
| JP | 2002-061552 | A | 2/2002 |
| JP | 2002-339835 | A | 11/2002 |
| JP | 2002-364489 | A | 12/2002 |
| WO | WO 01/65106 | A1 | 9/2001 |

* cited by examiner

DELIVERY PIPE

This is a 371 national phase application of PCT/JP2005/005069 filed 15 Mar. 2005, claiming priority to Japanese Application No. 2004-116352 filed 12 Apr. 2004, the contents of which are incorporated herein by reference.

FIELD OF THE INVENTION

The present invention relates to a delivery pipe (an injection pipe) of an internal combustion engine of a vehicle.

BACKGROUND OF THE INVENTION

In order to obtain a stable fuel injection in a multi-cylinder internal combustion engine, a fuel pressure pulsation caused due to fuel injection is desired to be decreased. Japanese Patent Publication 2002-339835 discloses a conventional delivery pipe including a double pipe structure with an inner pipe and an outer pipe for decreasing a fuel pressure pulsation. When receiving a fuel pressure pulsation, the inner pipe vibrates to be elastically deformed thereby decreasing the fuel pressure pulsation. When the inner pipe vibrates, air inside the inner pipe oscillates in pressure to cause a noise which is emitted from the inner pipe. However, no countermeasure has been taken to suppress the noise.

SUMMARY OF THE INVENTION

An object of the present invention is to provide a delivery pipe capable of suppressing a noise emitted from the delivery pipe.

A delivery pipe according to an embodiment of the present invention that achieves the above and other objects is described as follows:

(1) A delivery pipe according to the present invention includes an outer pipe, an inner pipe, and a noise emission decreasing device.

The outer pipe is connected to a plurality of fuel injectors of a multi-cylinder internal combustion engine.

The inner pipe is disposed in the outer pipe and has an open end through which an interior of the inner pipe communicates with atmosphere. When a wall of the inner pipe vibrates, a pressure of an interior of the inner pipe oscillates.

The noise emission decreasing device acts so as to decrease a noise emitted from the inner pipe.

(2) The noise emission decreasing device includes a mesh.

(3) The noise emission decreasing device includes a porous member.

(4) The noise emission decreasing device includes a vibration suppressing member provided to the inner pipe.

(5) The noise emission decreasing device includes an elastic tube fitted into the inner pipe.

(6) The noise emission decreasing device includes a wire harness inserted into the inner pipe.

(7) The noise emission decreasing device is provided at all portions of a cross section of an interior of the inner pipe.

(8) The noise emission decreasing device is provided at only a portion of a cross section of an interior of the inner pipe.

(9) The noise emission decreasing device is disposed at an entire circumference of an inside surface of the inner pipe.

(10) The noise emission decreasing device is disposed at only a portion of a circumference of an inside surface of the inner pipe.

(11) The noise emission decreasing device is disposed at only the open end of the inner pipe.

(12) The noise emission decreasing device is disposed at only a longitudinally intermediate portion of the inner pipe.

(13) The noise emission decreasing device is pressed into the inner pipe and is located inside the inner pipe.

(14) The noise emission decreasing device is bonded to an inner surface of the inner pipe and is located inside the inner pipe.

(15) The noise emission decreasing device includes a vibration damping sheet attached to an inner surface of the inner pipe.

(16) The noise emission decreasing device includes a vibration damping coating coated to an inner surface of the inner pipe.

(17) The inner pipe includes a main pipe and a branch pipe diverging from the main pipe and extending toward the fuel injector and the wire harness extends through the inner pipe to a respective fuel injector.

Technical advantages of the present invention are as follows:

According to the delivery pipe of item (1) above, since the delivery pipe is provided with the inner pipe and has a double pipe structure, the inner pipe can decrease a fuel pressure pulsation of fuel between the outer pipe and the inner pipe by being deformed when receiving the pressure pulsation.

Further, since the delivery pipe includes the noise emission decreasing device, the noise emission decreasing device suppresses a pressure oscillation of the interior of the inner pipe thereby decreasing a noise generated due to the pressure oscillation of the interior of the inner pipe and radiated from the inner pipe.

According to the delivery pipe of item (2) above, since the noise emission decreasing device includes a mesh, when an air vibration generated inside the inner pipe passes through the mesh, the energy of the pressure of the air vibration is absorbed by the mesh and is dispersed over the area of the mesh, whereby a noise of the air vibration is decreased.

According to the delivery pipe of item (3) above, since the noise emission decreasing device includes a porous member, when an air vibration generated inside the inner pipe passes through the porous member, the energy of the pressure of the air vibration is absorbed by the porous member and is dispersed over all portions of the porous member, whereby a noise of the air vibration is decreased.

According to the delivery pipe of item (4) above, since the noise emission decreasing device includes a vibration suppressing member provided to the inner pipe, vibration of the inner pipe can be damped by the vibration suppressing member accompanied by vibration damping of the interior of the inner pipe, whereby a noise from the delivery pipe is decreased.

According to the delivery pipe of item (5) above, since the noise emission decreasing device includes an elastic tube fitted into the inner pipe, vibration of the inner pipe can be damped by the elastic tube accompanied by vibration damping of the interior of the inner pipe, whereby a radiation noise from the delivery pipe is decreased.

According to the delivery pipe of item (6) above, since the wire harness is inserted into the inner pipe, an open portion of the cross section of the inner pipe, that is, a portion of the section which is not occupied by the inserted wire harness, is decreased so that emission of a noise passing through the open portion of the cross section is decreased. Further, since a space within the inner pipe is used for mounting the wire harness, a space required for mounting the wire harness which conventionally has been provided outside the delivery pipe can be reduced.

According to the delivery pipe of item (7) above, since the noise emission decreasing device is provided at all portions of the cross section of the interior of the inner pipe, a pressure oscillation of the interior of the inner pipe can be effectively decreased.

According to the delivery pipe of item (8) above, since the noise emission decreasing device is provided at only a portion of the cross section of the interior of the inner pipe, the noise emission decreasing device can be decreased in cost compared with the case of item (7) above.

According to the delivery pipe of item (9) above, since the noise emission decreasing device is provided at an entire circumference of an inside surface of the inner pipe, a pressure oscillation of the interior of the inner pipe can be effectively decreased.

According to the delivery pipe of item (10) above, since the noise emission decreasing device is provided at only a portion of a circumference of an inside surface of the inner pipe, the noise emission decreasing device can be decreased in cost compared with the case of item (9) above.

According to the delivery pipe of item (11) above or item (12) above, since the noise emission decreasing device is provided locally in a longitudinal direction of the inner pipe, the noise emission decreasing device can be decreased in cost compared with a case where the noise emission decreasing device is provided at all portions of the inner pipe in the longitudinal direction of the inner pipe.

According to the delivery pipe of item (13) above, since the noise emission decreasing device is pressed into the inner pipe, the inner pipe is pretensioned by the noise emission decreasing device. Due to the pretension, the inner pipe can better endure the compression load from the fuel. Further, since the noise emission decreasing device is located inside the inner pipe, a space for mounting the delivery pipe is not increased in spite of mounting the noise emission decreasing device.

According to the delivery pipe of item (14) above, since the noise emission decreasing device is located inside the inner pipe, a space for mounting the delivery pipe is not increased in spite of mounting the noise emission decreasing device.

According to the delivery pipe of item (15) above, since the noise emission decreasing device includes a vibration damping sheet attached to an inner surface of the inner pipe, vibration of the inner pipe can be damped by the vibration damping sheet accompanied by vibration damping of the interior of the inner pipe, whereby a noise from the delivery pipe is decreased.

According to the delivery pipe of item (16) above, since the noise emission decreasing device includes a vibration damping coating coated to an inner surface of the inner pipe, vibration of the inner pipe can be damped by the vibration damping coating accompanied by vibration damping of the interior of the inner pipe, whereby a noise from the delivery pipe is decreased.

According to the delivery pipe of item (17) above, since the inner pipe includes the branch pipe, by changing a position and a cross section of the branch pipe, a vibration pattern of the inner pipe and a columnar vibration pattern and a resonance frequency of the interior of the inner pipe can be changed or controlled, whereby a noise from the delivery pipe is decreased.

BRIEF DESCRIPTION OF THE DRAWINGS

The delivery pipe of the various embodiments of the present invention will now be explained with reference to the accompanying drawings, in which.

DETAILED DESCRIPTION OF PREFERRED EMBODIMENTS

Figure 1:
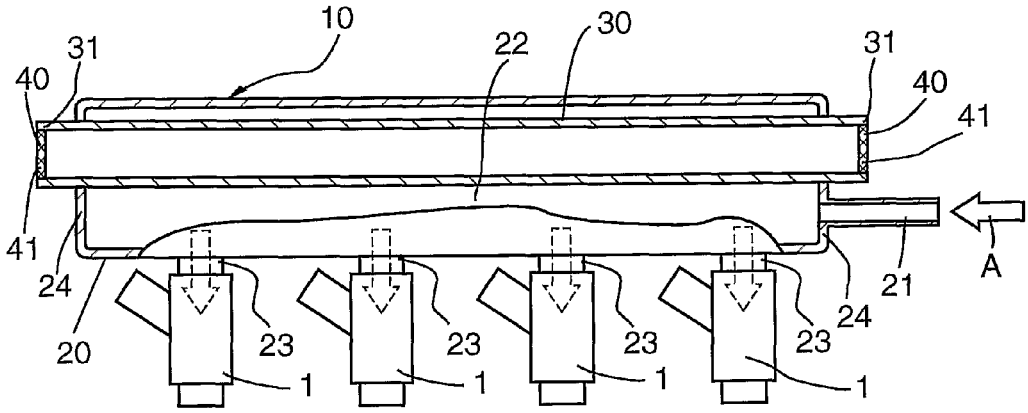
FIG. 1 is a front elevational view of a delivery pipe according to a first embodiment of the present invention.

Several embodiments of the present invention will be explained. Portions generic (common or similar) throughout all of the embodiments of the invention are denoted with the same reference numerals throughout all of the embodiments of the invention.

First, portions generic throughout all of the embodiments of the invention will be explained with reference to FIGS. 1 and 2.

A delivery pipe 10 according to the present invention includes an outer pipe 20, an inner pipe 30, and a noise emission decreasing device 40 for decreasing a noise emitted from the inner pipe 30. The outer pipe 20 is connected to a plurality of fuel injectors 1 of a multi-cylinder internal combustion engine. The inner pipe 30 is disposed in the outer pipe 20 and has an open end through which an interior of the inner pipe communicates with atmosphere at at least one end of the inner pipe 30. When a wall of the inner pipe 30 vibrates, a pressure of an interior of the inner pipe 30 oscillates. The noise emission decreasing device 40 acts so as to decrease oscillation of the pressure of the interior of the inner pipe 30. The delivery pipe 10 has a double pipe structure having the outer pipe 20 and the inner pipe 30.

The outer pipe 20 and the inner pipe 30 define a fuel passage 22 therebetween through which fuel flows and is delivered to respective fuel injectors 1. The outer pipe 20 is made from, for example, synthetic resin or metal. The outer pipe 20 is connected to the same number of injection passages 23 as the number of the injectors 1 connected to the outer pipe 20 and has a connector 21 at a longitudinal end of the outer pipe 20. As illustrated by arrow A in FIGS. 1, 3, 4 and 6, the fuel flows through the connector 21 into the fuel passage 22 and flows from the fuel passage 22 to the injection passages 23. The fuel injectors 1 inject fuel in a predetermined injection order.

The inner pipe 30 extends in the outer pipe 20 in a longitudinal direction of the outer pipe 20. The inner pipe 30 is made from, for example, synthetic resin or metal. The inner pipe 30 is fixed to the outer pipe 20 at end plates 24 of the outer pipe 20. End portions of the inner pipe 30 may extend through the end plates 24 of the outer pipe 20. If, for example, both of the outer pipe 20 and the inner pipe 30 are made from metal, the inner pipe 30 may be fixed to the end plates 24 of the outer pipe 20 by welding. The interior of the inner pipe 30 is fluidly separated from the fuel passage 22.

Preferably, the inner pipe 30 has a wall thickness smaller than a wall thickness of the outer pipe 20. Preferably, the inner pipe 30 has a substantially rectangular cross section so that a wall of the inner pipe 30 has a flat portion 33. When a fuel pressure acts on the wall of the inner pipe 30, the inner pipe 30 can be deformed relatively easily at the flat portion 33 in a direction perpendicular to a longitudinal direction of the inner pipe 30. By the deformation, the inner pipe 30 absorbs a pressure pulsation generated in the fuel at the time of fuel injection.

At least one longitudinal end 31 of the inner pipe 30 is open so that the interior of the inner pipe 30 communicates with the atmosphere through the open end 31. In the embodiment shown, the inner pipe 30 has opposite open ends. The open end 31 may be open at an entire transverse cross section of the inner pipe or at only a portion of the transverse cross section of the inner pipe.

The noise emission decreasing device 40 is a device for absorbing and dispersing a vibration of the interior of the inner pipe 30 generated when the wall of the inner pipe 30 vibrates and is alternately deformed thereby decreasing a noise emitted from the open end 31 of the inner pipe 30. The noise emission decreasing device 40 may be any one of a mesh (mesh member) 41 provided in or to the inner pipe 30, (or as shown in FIGS. 2-6) (*b*) a porous member 42 provided in or to the inner pipe 30, (*c*) a vibration damping member 43 provided in or to the inner pipe 30, (*d*) an elastic member 44 provided in or to the inner pipe 30, and (*e*) a wire harness 45 inserted in the inner pipe 30 so as to extend through the inner pipe 30.

Technical effects and advantages of the portions generic to all of the embodiments of the present invention will now be explained.

Since the delivery pipe according to the present invention has a double pipe structure including the outer pipe 20 and the inner pipe 30, the pressure vibration of the fuel flowing in the fuel passage between the outer pipe 20 and the inner pipe 30 is effectively decreased by the inner pipe 30 being deformed. Though a noise or vibration of the interior (air) of the inner pipe 30 is likely to be emitted to the environment because the at least one end of the inner pipe 30 is an open end, the noise emitted from the inner pipe 30 (a part of an engine noise) can be effectively decreased by the noise emission decreasing device 40 provided in or to the inner pipe 30.

Since the inner pipe 30 has an open end at at least one end of the inner pipe, a breakage and/or a permanent deformation of the inner pipe 30, which is likely to occur due to a welding heat if opposite ends of the inner pipe are closed and the inner pipe and the outer pipe are welded to each other, will be prevented.

Next, portions unique to each embodiment of the present invention will be explained.

Embodiment 1

Figure 2:
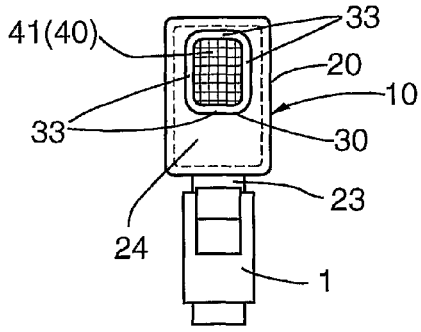
FIG. 2 is a side elevational view of the delivery pipe according to the first embodiment of the present invention.

FIGS. 1 and 2

In Embodiment 1 of the present invention, the noise emission decreasing device 40 includes a mesh (mesh member) 41 provided in or to the inner pipe 30. The inner pipe 30 has a simple structure as a pipe. The mesh 41 is made from, for example, synthetic resin or metal. The mesh has a relatively fine mesh structure. The mesh 41 may, for example, be coupled or fixed to the inner pipe 30 in the same manner as a cap is coupled or fixed to a pipe, may be pressed into the inner pipe 30, or may be bonded to an inner surface of the inner pipe 30.

The mesh 41 may be disposed at the open end 31 of the inner pipe 30 or at a place other than the open end, for example, at a longitudinally intermediate portion of the inner pipe 30. In FIG. 1, the mesh 41 is disposed at the open end 31. When the inner pipe 30 has opposite open ends 31, the mesh 41 may be disposed at both of the open ends 31 or at one of the open ends 31.

The mesh 41 may be disposed at all portions of a cross section of an interior of the inner pipe 30 or at only a portion of a cross section of an interior of the inner pipe 30.

In Embodiment 1 of the present invention, the following technical advantages are further obtained:

Since the noise emission decreasing device 40 includes the mesh 41, when the air vibration generated inside the inner pipe 30 passes through the mesh 41, an energy of the vibration is absorbed and dispersed by the mesh 41, whereby the noise emitted from the delivery pipe 10 is effectively decreased.

When the mesh 41 is pressed into the inner pipe 30, a pretension is generated in the inner pipe 30. As a result, the inner pipe 30 can better endure the compression loaded on the inner pipe 30 from the fuel between the outer pipe 20 and the inner pipe 30.

Further, since the mesh 41 is located in the inner pipe 30, a space required for mounting the delivery pipe 10 is not increased despite provision of the mesh 41.

Furthermore, since the inner pipe 30 has a simple structure, a cost for manufacturing the delivery pipe 10 is low.

Embodiment 2

FIG. 3

In Embodiment 2 of the present invention, the noise emission decreasing device 40 includes a porous member 42 provided in or to the inner pipe 30. The inner pipe 30 has a simple structure as a pipe. The porous member 42 is made from, for example, sponge. The porous member 42 may, for example, be pressed into the inner pipe 30, may be inserted into the inner pipe 30, or may be fixed to an inside surface of the inner pipe 30 by an adhesive.

Figure 3:
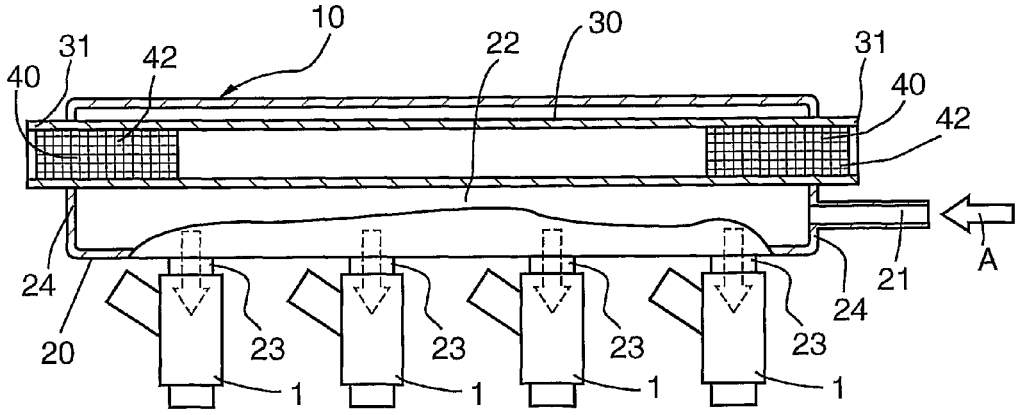
FIG. 3 is a front elevational view of a delivery pipe according to a second embodiment of the present invention.

The porous member 42 may be disposed at only the open end 31 of the inner pipe 30 and the vicinity thereof, or may be disposed at a longitudinally intermediate portion of the inner pipe 30, or may be disposed at all portions of the inner pipe in the longitudinal direction of the inner pipe 30. In FIG. 3, the porous member 42 is located at the longitudinal end of the inner pipe 30 and the vicinity thereof. When the inner pipe 30 has opposite open ends 31, the porous member 42 may be at both ends 31 or may be at only one end 31. The porous member 42 may be provided at all portions of a cross section of the interior of the inner pipe 30 or may be provided at only a portion of a cross section of the interior of the inner pipe 30.

In Embodiment 2 of the present invention, the following technical advantages are further obtained:

Since the noise emission decreasing device 40 includes the porous member 42, when the air vibration generated inside the inner pipe 30 passes through the porous member 42, an energy of the vibration is absorbed and dispersed by the porous member 42, whereby the noise emitted from the delivery pipe 10 is effectively decreased.

When the porous member 42 is pressed into the inner pipe 30, a pretension is generated in the inner pipe 30. As a result, the inner pipe 30 can better endure the compression loaded on the inner pipe 30 from the fuel between the outer pipe 20 and the inner pipe 30.

Further, since the porous member 42 is located in the inner pipe 30, a space required for mounting the delivery pipe 10 is not increased despite provision of the porous member 42.

Furthermore, since the inner pipe 30 has a simple structure, a cost for manufacturing the delivery pipe 10 is low.

Embodiment 3

FIG. 4

In Embodiment 3 of the present invention, the noise emission decreasing device 40 includes a vibration damping member 43 provided in or to the inner pipe 30. The inner pipe 30 has a simple structure as a pipe. The vibration damping member 43 includes a vibration damping sheet or a vibration damping coating. The vibration damping member 43 may be attached (for example, fixed by bonding) or coated to an inside surface of the inner pipe 30.

Figure 4:
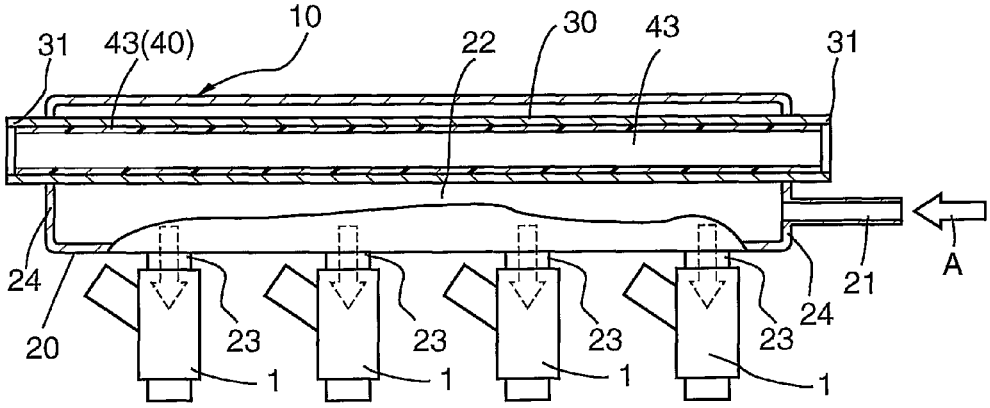
FIG. 4 is a front elevational view of a delivery pipe according to a third embodiment of the present invention.
Figure 5:
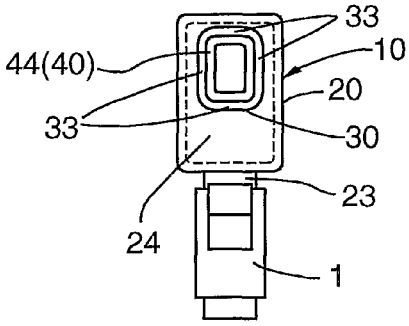
FIG. 5 is a side elevational view of a delivery pipe according to a fourth embodiment of the present invention.
Figure 6:
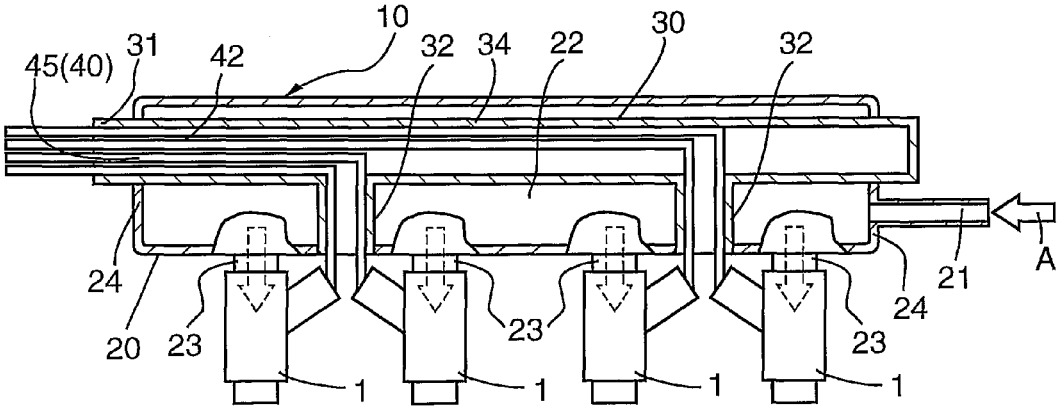
FIG. 6 is a front elevational view of a delivery pipe according to a fifth embodiment of the present invention.

The vibration damping member 43 may be disposed at only the open end 31 of the inner pipe 30 and the vicinity thereof, or may be disposed at a longitudinally intermediate portion of the inner pipe 30, or may be disposed at all portions of the inner pipe in the longitudinal direction of the inner pipe 30. In FIG. 4, the vibration damping member 43 is located at all portions of the inner pipe in the longitudinal direction of the inner pipe 30. When the inner pipe 30 has opposite open ends 31, the vibration damping member 43 may be at both ends 31 or may be at only one end 31. The vibration damping member 43 may be disposed at an entire circumference of an inside surface of the inner pipe 30 or may be disposed at an inside surface of only a portion of a circumference of the inner pipe 30.

In Embodiment 3 of the present invention, the following technical advantages are further obtained:

Since the noise emission decreasing device 40 includes the vibration damping member 43, the vibration damping member 43 damps vibration of a wall of the inner pipe 30 and decreases an energy of vibration of the inner pipe 30 itself, whereby the noise emitted from the inner pipe 30 is effectively decreased.

When the vibration damping member 43 is attached or coated to the inside surface of the inner pipe 30, the vibration damping member 43 does not protrude out from the delivery pipe 10. As a result, a space required for mounting the delivery pipe 10 is not increased despite provision of the vibration damping member 43.

Furthermore, since the inner pipe 30 has a simple structure, a cost for manufacturing the delivery pipe 10 is low.

Embodiment 4

FIG. 5

In Embodiment 4 of the present invention, the noise emission decreasing device 40 includes an elastic member 44 provided in or to the inner pipe 30. The inner pipe 30 has a simple structure as a pipe. The elastic member 44 includes, for example, a tube made from rubber. The elastic member 44 may be pushed into the inner pipe 30. The elastic member 44 may be fixed to the inside surface of the inner pipe 30 by, for example, an adhesive. The elastic member 44 contacts the inside surface of the inner pipe 30.

The elastic member 44 may be disposed at only the open end 31 of the inner pipe 30 and the vicinity thereof, or may be disposed at a longitudinally intermediate portion of the inner pipe 30, or may be disposed at all portions of the inner pipe in the longitudinal direction of the inner pipe 30. When the inner pipe 30 has opposite open ends 31, the elastic member 44 may be at both ends 31 or may be at only one end 31. The elastic member 44 may be disposed at an entire circumference of an inside surface of the inner pipe 30 or may be disposed at an inside surface of only a portion of a circumference of the inner pipe 30.

In Embodiment 4 of the present invention, the following technical advantages are further obtained:

Since the noise emission decreasing device 40 includes the elastic member 44, the elastic member 44 damps vibration of a wall of the inner pipe 30 and decreases an energy of vibration of the inner pipe 30 itself, whereby the noise emitted from the inner pipe 30 is effectively decreased.

When the elastic member 44 is pressed into the inner pipe 30, a pretension is generated in the inner pipe 30. As a result, the inner pipe 30 can better endure the compression loaded on the inner pipe 30 from the fuel between the outer pipe 20 and the inner pipe 30. Further, since the elastic member 44 does not protrude out from the delivery pipe 10, a space required for mounting the delivery pipe 10 is not increased despite provision of the elastic member 44.

Furthermore, since the inner pipe 30 has a simple structure, a cost for manufacturing the delivery pipe 10 is low.

Embodiment 5

FIG. 6

In Embodiment 5 of the present invention, the noise emission decreasing device 40 includes a wire harness 45 provided in the inner pipe 30 so as to extend through the inner pipe 30.

The inner pipe 30 includes a main pipe 34 and a plurality of branch pipes 32 diverging from the main pipe 34 and extending toward the fuel injector 1 and the wire harness 45 extends through the inner pipe 30 to a respective fuel injector 1. The number of the branch pipes 32 may be equal to the number of the injectors 1 or may be smaller than the number of the injectors 1.

The wire harness 45 is a wire harness connected to the injectors 1. The wire harness 45 extends into the inner pipe 30 through the open end 31 of the inner pipe 30 and is bent at respective branch pipes 32 to extend through the branch pipes 32 to the respective injectors 1.

In Embodiment 5 of the present invention, the following technical advantages are further obtained:

Since the wire harness 45 extends through the inner pipe 30, a cross section of the interior of the inner pipe 30 through which a noise generated in the inner pipe is emitted to the environment is reduced, whereby the noise emitted from the inner pipe 30 is effectively decreased.

Further, since the interior of the inner pipe 30 is utilized as a space for disposing the wire harness 45, the wire harness mounting space is reduced compared with a conventional case where a wire harness is disposed outside the delivery pipe 10.

Further, the branch pipe 32 acts as a breathing hole and the branch pipe 32 changes a rigidity of the inner pipe 32. By changing a position in the longitudinal direction of the inner pipe 30 and a cross section of the branch pipe 32, a vibration pattern of the inner pipe 30 and a columnar vibration pattern and a resonance frequency of the interior of the inner pipe 30 can be changed or controlled, whereby a noise from the delivery pipe is decreased.

The wire harness 45 may be a wire harness connected to parts other than the injector 1.

Several embodiments of the present invention are specifically illustrated and/or described herein. However, it will be appreciated that modifications and variations of the present invention are covered by the above teachings and within the purview of the appended claims without departing from the sprit and intended scope of the invention.

The invention claimed is:

1. A delivery pipe comprising:

an outer pipe having a longitudinal direction;

an inner pipe extending through and in the longitudinal direction of the outer pipe, an interior of the inner pipe being fluidly isolated from a space between the inner pipe and the outer pipe; and a noise emission decreasing device made from a mesh and located within the inner pipe, the noise emission decreasing device having a cap-like structure that covers an open end of the inner pipe, wherein the outer pipe is connected to a plurality of fuel injectors of a multi-cylinder internal combustion engine, the outer pipe being provided with a connector for causing fuel to flow to a fuel passage defined between the outer pipe and the inner pipe, wherein the noise emission decreasing device is made separately from the inner pipe and fixed to the open end of the inner pipe so as to act to decrease a noise emitted from the inner pipe, the noise emission decreasing device being disposed at only the open end of the inner pipe, and being provided at the entire cross section of the open end of the inner pipe, and wherein the interior of the inner pipe communicates with the atmosphere through the noise emission decreasing device.

* * * * *